US005620206A

United States Patent [19]

Flores

[11] Patent Number: 5,620,206

[45] Date of Patent: Apr. 15, 1997

[54] APPARATUS FOR BINDING MATERIALS

[76] Inventor: Adalberto Flores, 80 Kimball Dr., Rochester, N.Y. 14623

[21] Appl. No.: 445,141

[22] Filed: May 19, 1995

[51] Int. Cl.[6] ..... B42D 1/00

[52] U.S. Cl. ..... 281/21.1; 281/15.1; 402/8

[58] Field of Search ..... 281/21.1, 15.1, 281/36, 28; 402/8, 19

[56] References Cited

U.S. PATENT DOCUMENTS

| | | | |
|---|---|---|---|
| 416,621 | 12/1889 | Howd | 402/8 |
| 474,509 | 5/1892 | Wagler . | |
| 549,080 | 10/1895 | Schonenberger . | |
| 879,573 | 2/1908 | Neuner . | |
| 884,659 | 4/1908 | Holman | 402/19 |
| 893,513 | 7/1908 | Juengst . | |
| 999,285 | 8/1911 | Williams . | |
| 1,070,450 | 8/1913 | Griesinger . | |
| 1,142,021 | 6/1915 | Chambers . | |
| 1,280,790 | 10/1918 | McMann . | |
| 1,476,615 | 12/1923 | Horsfield . | |
| 1,526,533 | 2/1925 | D'Eggis . | |
| 1,630,487 | 5/1927 | Harrison | 402/8 |
| 2,194,985 | 3/1940 | Prince . | |
| 3,467,479 | 9/1969 | Holes et al. . | |
| 3,485,564 | 12/1969 | Holes et al. . | |
| 3,608,115 | 9/1971 | Chou et al. . | |

FOREIGN PATENT DOCUMENTS

| | | |
|---|---|---|
| 1931456 | 1/1971 | Germany . |
| 12542 | of 1899 | United Kingdom . |
| 4599 | of 1912 | United Kingdom . |

*Primary Examiner*—Willmon Fridie, Jr.
*Attorney, Agent, or Firm*—Nixon, Hargrave, Devans & Doyle

[57] ABSTRACT

An apparatus for binding at one or more sets of materials includes at least one stitch and a fastener. Each set of materials has a first side which extends along a first axis. The stitch is secured adjacent to the first side with a portion of the stitch extending away from the first side to define an opening between the stitch and the first side. The fastener includes first and second elongated members which each have a pair of opposing ends. One end of the first elongated member is connected to or integrally formed with one end of the second elongated member. The first elongated member is capable of being passed through the opening between the stitch and the set of materials. The other ends of the first and second elongated members are capable of being detachably secured together to bind the sets of materials together. The apparatus may include a cover having a spine extending along a second axis with a front and a back cover piece connected to the spine along the second axis. A securing device secures at least the first elongated member to the spine. The stitch may include a U-shaped section with a base and a pair of legs each having an end. The legs of the stitch extend out from the base of the U-shaped section and are substantially parallel to each other until a first bend is reached where the legs are bent to be substantially perpendicular to the U-shaped section while remaining substantially parallel to each other. The legs continue to extend to a second bend where the legs are bent towards each other so that the legs overlap. Alternatively, the stitch may be a standard U-shaped stitch.

23 Claims, 8 Drawing Sheets

APPARATUS FOR BINDING MATERIALS

FIELD OF THE INVENTION

This invention relates to an apparatus for binding materials, such as booklets and/or magazines, together within a protective cover.

BACKGROUND OF THE INVENTION

Frequently, book binders, magazine subscribers, librarians, teachers, professors, and other collectors would like to secure journals, magazines, booklets, and other types of materials together to preserve them for future use or reference. Unfortunately, very few devices have been developed to secure these types of materials together and the few devices that do exist have drawbacks.

For example, one type of device for securing sets of materials together is illustrated in U.S. Pat. No. 999,285 to Williams, U.S. Pat. No. 1,280,790 to McMann, and in U.S. Pat. No. 2,194,985 to Price. In this type of device, two or more openings are punched through each set of materials adjacent the spine of each set of materials. Once the openings are punched through, a strap is passed through the openings and one end of the strap is secured to the front portion of the cover and the other end of the strap is secured to the back portion of the cover. The obvious disadvantage of this device is that the sets of materials typically do not provide a border along the spine to receive the openings. As a result, the openings often extend through text, drawings, and/or pictures in the sets of materials. Additionally, since the opening are set off from the normal spine for each set of materials, when opened the straps passing through the openings impose a strong bias to close the sets of materials. This bias makes the materials difficult and cumbersome to use.

Another type of device for securing materials together is shown in British Patent No. 4599 to Douglas, U.S. Pat. No. 549,080 to Schoenberger, and U.S. Pat. Nos. 3,467,479 and 3,485,564 to Holes et al. In this type of device, a strap is passed through staples connected to each set of materials and then one end of the strap is secured to a front portion of a cover and the other end of the strap is secured to a back portion of the cover. One disadvantage of this type of device is that a cover with a locking mechanism incorporated in the front and back portions of the cover is required to be able to secure the sets of material together. These types of covers are typically difficult and cumbersome to use and are expensive to manufacture. Another disadvantage with this type of device is with the type of stitches used. For example, in Douglas and in Schoenberger the stitches are not well secured to the materials and may easily dislodge. In Holes et al, the stitches are more securely fastened to the materials, but include a mounting tab which extends well past the spine of the material. As with the mounting holes punched through the materials, the tabs will also cover up text, drawings, and/or photographs located along the edge of the spine and will bias the materials to close when opened making the device difficult and cumbersome to use.

SUMMARY OF INVENTION

An apparatus in accordance with the present invention for binding one or more sets of materials or pages together includes at least one stitch and a fastener. Each set of materials has a first side which extends along a first axis. The stitch is secured adjacent to the first side with a portion of the stitch extending away from the first side to define an opening between the stitch and the first side. The fastener includes first and second elongated members which each having a pair of opposing ends. One end of the first elongated member is connected to or integrally formed with one end of the second elongated member. The first elongated member is capable of being passed through the opening between the stitch and the set of materials. The other ends of the first and second elongated members are capable of being detachably secured together to bind the sets of material or pages together. The apparatus may include a cover having a spine extending along a second axis with a front and a back cover piece connected to the spine along the second axis. A securing device secures at least the first elongated member to the spine. The stitch may include a U-shaped section with a base and a pair of legs each having an end. The legs of the stitch extend out from the base of the U-shaped section and are substantially parallel to each other until a first bend is reached where the legs are bent to be substantially perpendicular to the U-shaped section while remaining substantially parallel to each other. The legs continue to extend to a second bend where the legs are bent towards each other so that the legs overlap. Alternatively, the stitch may be a standard U-shaped stitch.

With the apparatus, book binders, magazine subscribers, librarians, teachers, professors, and others collectors of materials can easily bind their materials together for storage and future reference. The fastener is very accessible making it easy to add or remove materials. Unlike prior devices, the apparatus does not require holes to be punched through each set of materials which could result in lost text, drawings, and/or pictures. Additionally, the fastener and/or the stitches will not bias the apparatus closed so the apparatus will remain open wherever it is opened to. Further, a stitch has been designed which will remain securely fastened to the set of materials and is capable of being located adjacent to the side of each set of materials so information near the side will not be lost.

BRIEF DESCRIPTION OF THE DRAWINGS

FIG. 2(*b*) is a cross-sectional, side view of the binding apparatus shown in FIG. 1 with the fastener in a closed position;

FIG. 3(*b*) is an enlarged view of another stitch used in the binding apparatus;

FIG. 4(*b*) is a cross-sectional view of another embodiment for the stitch attached to the booklet;

FIG. 5(*b*) is a cross-sectional, side view of the binding apparatus shown in FIG. 5(*a*) with the rigid fastener in an open position;

FIG. 5(*c*) is a cross-sectional, side view of the binding apparatus shown in FIG. 5(*a*) with the rigid fastener in a closed position;

FIG. 6(*b*) is a cross-sectional side view of the fastener taken along lines 6(*b*)—6(*b*) in FIG. 6(*a*);

FIG. 7(*b*) is a cross-sectional side view of the fastener shown in FIG. 7(*a*);

FIG. 8(*b*) is a cross-sectional side view of the fastener shown in FIG. 8(*a*) in a closed position.

DETAILED DESCRIPTION

Figure 1:
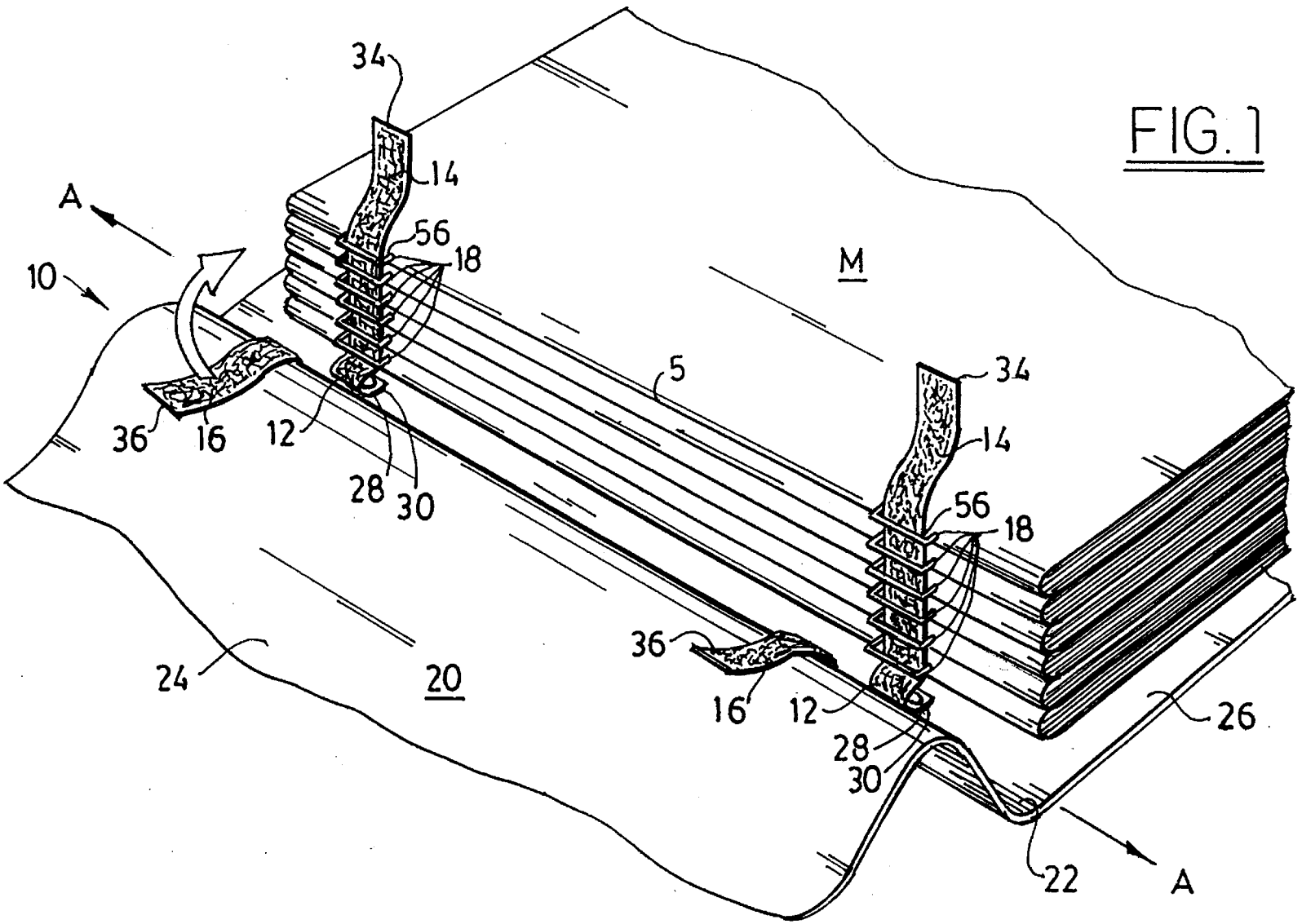
FIG. 1 is a perspective view of a binding apparatus with a flexible fastener in accordance with the present invention.

A binding apparatus 10 for detachably securing one or more sets of materials M or other items, such as individual pages (not shown), together is illustrated in FIG. 1. Binding apparatus 10 includes a fastener 12 which has first and second elongated members 14 and 16 and a pair of stitches 18 for each set of materials M. Binding apparatus 10 may also include a cover 20 with a spine 22 which extends along an axis A—A and with front and back cover pieces 24 and 26. Binding apparatus 10 provides an easy to use and inexpensive apparatus 10 for detachably binding materials M together.

Referring more specifically to FIG. 1, first and second elongated members 14 and 16 for fastener 12 each have a pair of opposing ends 28, 30, 34, and 36. Ends 28 and 30 of first and second elongated members 14 and 16 are secured together by a rivet 32. Although a rivet 32 is used to secure ends 28 and 30 together, other devices to secure ends 28 and 30 together could be used, such as stitching or glue or elongated members 14 and 16 could be integrally formed together at ends 28 and 30. Rivet 32 extends through ends 28 and 30 and is secured to spine 22 of cover 20. Although in this particular embodiment, both elongated members 14 and 16 are secured to spine 22, spine 22 may only be secured to one elongated member 14 or 16, if desired. Additionally, rivet 32 or other securing device may be secured anywhere along the length of elongated members 14 and/or 16. Other ends 34 and 36 of first and second elongated members 14 and 16 are capable of being detachably secured together. In this particular embodiment, fastener 12 is made from a flexible material, such as velcro® with first elongated member 14 being the hook side of the velcro and second elongated member 16 being the eye side of the velcro®, although other types of fasteners 12, such as those shown in FIGS. 5(*a–c*), 6(*a–b*), 7(*a–b*), and 8(*a–b*) could be used. Since in this particular embodiment, first and second elongated members 14 and 16 are made from velcro®, first and second elongated members 14 and 16 can be detachably secured together along their entire length. Fastener 12 with first and second elongated members 14 and 16 is much easier to use and manufacture than prior devices because members 14 and 16 are easily accessible and do not require the incorporation and use of any type of difficult and cumbersome locking mechanism in front and back cover pieces 24 and 26. Although fastener 12 is preferably connected to cover 20, cover 20 is not necessary to bind sets of materials M together.

Figure 5B:
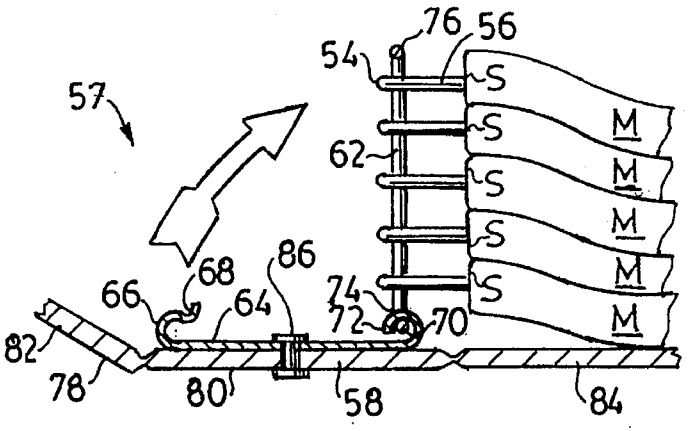
FIG. 5(*a*) is a perspective view of another binding apparatus with a rigid fastener in accordance with the present invention.
Figure 5C:
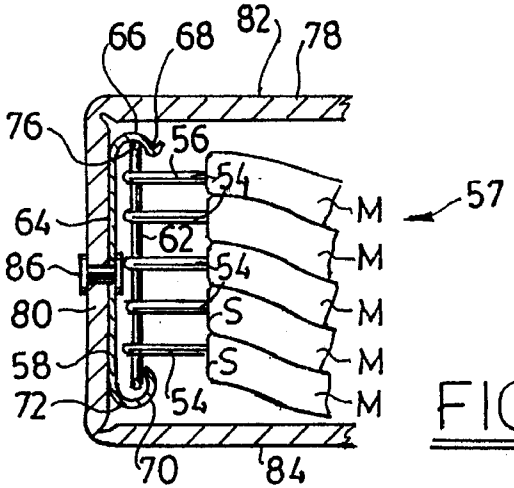
Figure 5A:
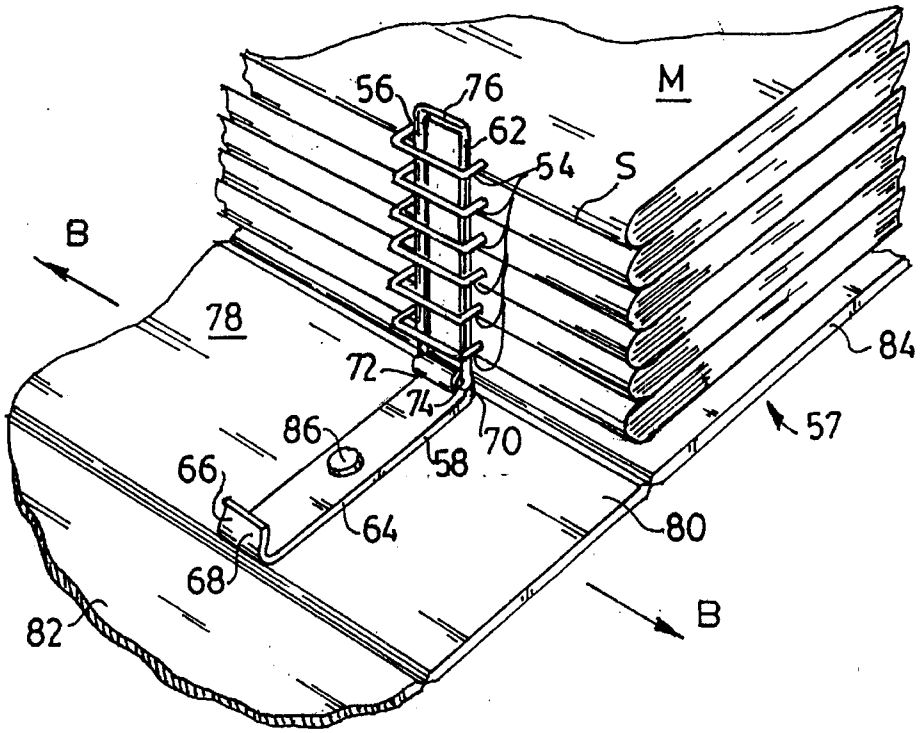

Cover 20 for binding apparatus 10 includes spine 22, which extends along axis A—A, and front and back cover pieces 24 and 26. In this particular embodiment, front and back cover pieces 24 and 26 are substantially rectangular and are connected to opposing sides of spine 22 and substantially parallel to axis A–A, although front and back cover pieces 24 and 26 could have other shapes, if desired. Preferably, the dimensions of front and back cover pieces 24 and 26 are larger than the dimensions of the sets of material M being bound so that when cover 20 is closed sets of materials M are protected. In this particular embodiment, cover 20 is made from a soft material such as plastic, although cover 20 could be made from other more rigid materials, such as cardboard or plastic, as shown in FIGS. 5(*a–c*). Complicated locking mechanisms in from and back cover pieces 24 and 26 are unnecessary to bind sets of materials M together.

Figure 3A:
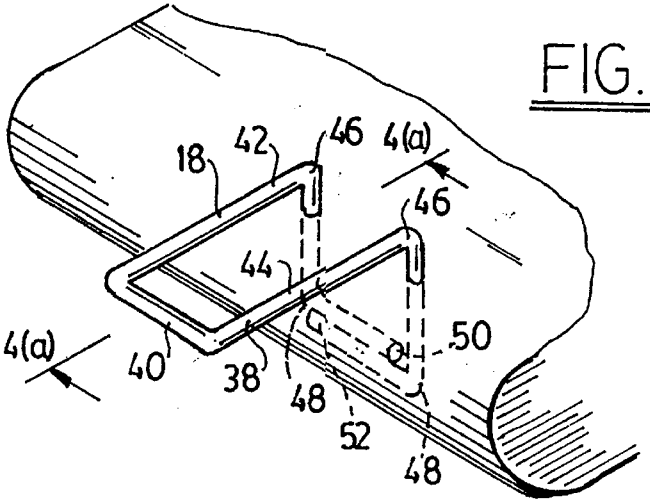
FIG. 3(*a*) is an enlarged view of a stitch used in the binding apparatus.
Figure 3B:
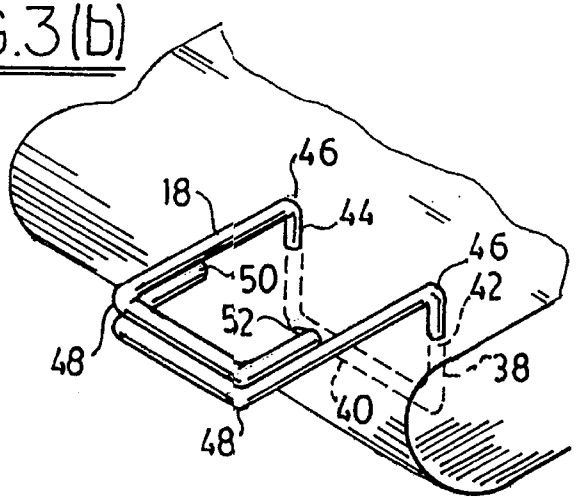

Referring to FIGS. 3(*a–b*), enlarged views of stitch 18 used in binding apparatus 10 are illustrated. As shown in FIG. 3(*a*), stitch 18 has a U-shaped section 38 with a base 40 and a pair of legs 42 and 44. Legs 42 and 44 are substantially parallel to each other and extend out from base 40 of U-shaped section 38. At a first bend 46, legs 42 and 44 are bent to be substantially perpendicular to U-shaped section 38 while remaining substantially parallel to each other. At a second bend 48, legs 42 and 44 are bent towards each other so that legs 42 and 44 overlap, with ends 50 and 52 of each leg 42 and 44 adjacent second bends 48. In an alternative embodiment as shown in FIG. 3(*b*), stitch 18 is substantially the same as in FIG. 3(*a*) except that the position of U-shaped section 38 is reversed and ends 50 and 52 of legs 42 and 44 extend around second bend 48. Although stitch 18 with first and second bends 46 and 48 is shown, other types of stitches 18, such as a standard U-shaped stitch 54 which only has a second bend 48 where legs 42 and 44 overlap when secured through set of materials M, as shown in FIG. 5(*a–c*) may be used. As shown in FIGS. 3(*a–b*), stitch 18 is located adjacent side S of sets of materials M so that text, drawings, and/or pictures in the materials M will not be lost. Additionally, locating stitch 18 adjacent to side S does not create any bias which will cause sets of materials M to close when opened making apparatus 10 easier to use. Further, stitch 18 is constructed to remain securely fastened to each set of materials M and will not dislodge. In this particular embodiment, side S of each set of materials is also the spine for each set of materials, although with stitch 18 each set of materials M does not need a spine to be secured together.

Figure 4A:
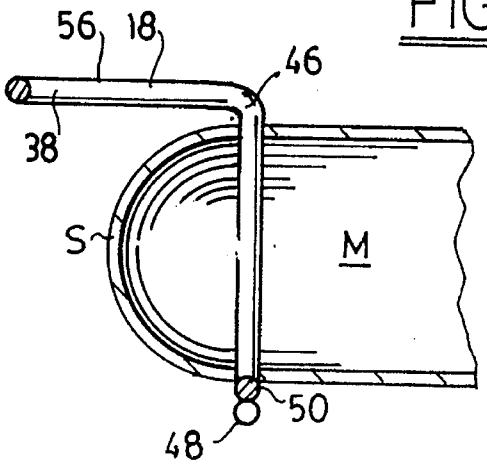
FIG. 4(*a*) is a cross-sectional view of the stitch taken along lines 4(*a*)—4(*a*) in FIG. 3(*a*) attached to a booklet.
Figure 4B:
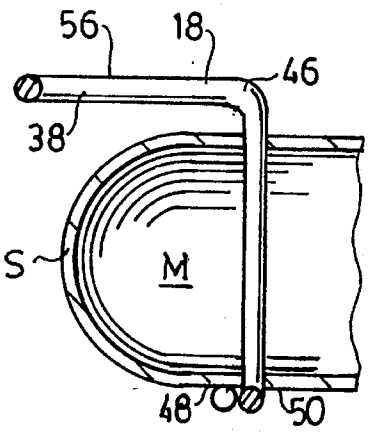

Referring to FIGS. 4(*a–b*), cross-sectional views of stitch 18 attached to a set of materials M are illustrated. As shown in FIG. 4(*a*), stitch 18 is secured adjacent to spines S of sets of materials M. Stitch 18 is positioned in each set of materials M so that U-shaped section 38 extends away from sides S to define an opening 56 between base 40 of U-shaped section 38 and sides S. The portion of legs 42 and 44 between first and second bends 46 and 48 passes through each set of materials M. First bend 46 is adjacent the top of each set of materials M and second bend 48 is adjacent the bottom of each set of materials M. At the second bend 48, legs 42 and 44 extend toward each other with one leg 42 and 44 on top of the other as shown in FIG. 4(*a*) or with legs 42 and 44 adjacent each other as shown in FIG. 4(*b*).

Referring back to FIG. 1, opening 56 between base 40 of U-shaped section 38 and sides S of each set of materials M is more clearly illustrated. Materials M may be booklets, magazines, or any other collection of pages which have a side S and may also be a set of pages stapled together with stitch 18. In this particular embodiment, each set of materials M has a pair of stitches 18, although each set of materials M could have only one stitch 18 or more than two stitches 18 if desired. Sets of materials M are stacked so that openings 56 defined by U-shaped sections 38 of stitches 18 and sides S line up in two columns.

Figure 2A:
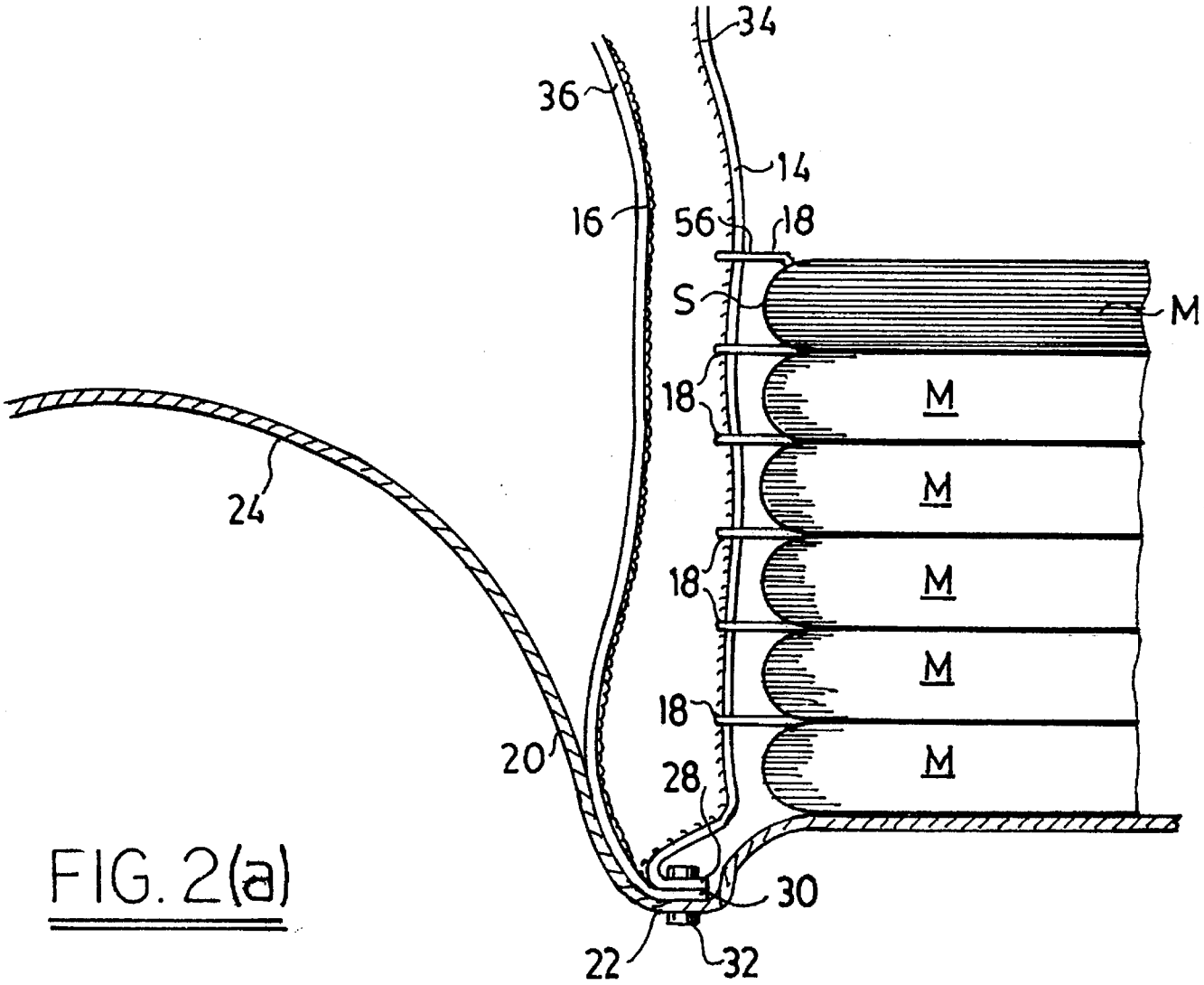
FIG. 2(*a*) is a cross-sectional, side view of the binding apparatus shown in FIG. 1 with the fastener in an open position.
Figure 2B:
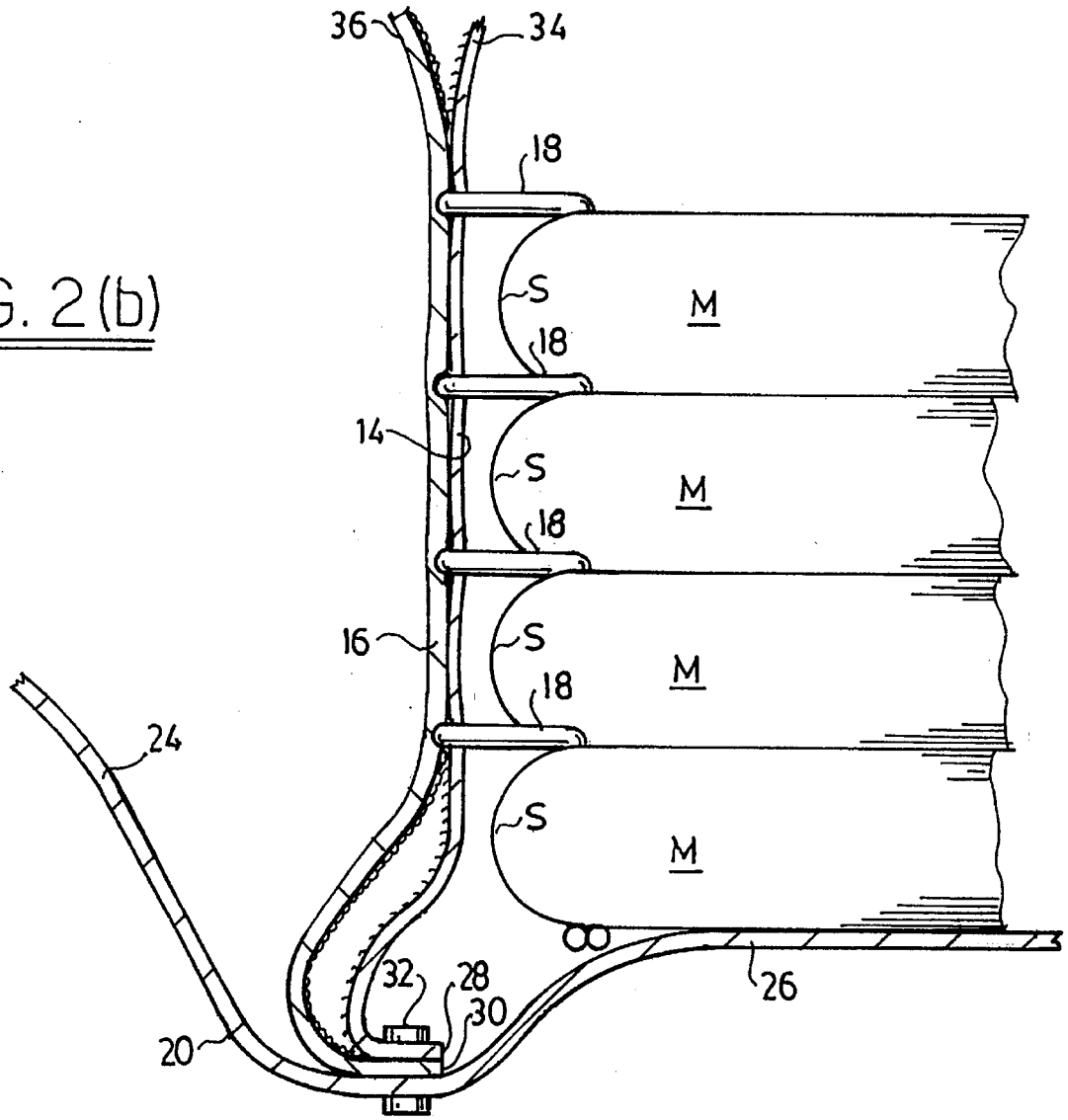

The operation of binding apparatus 10 is illustrated with reference to FIGS. 1 and 2(*a–b*). As shown in FIG. 1, the two sets of first and second elongated members 14 and 16 are secured at one end 28 and 30 by rivets 32 to spine 22 of cover 20 at two locations. Next, at least one stitch 18 is secured to each set of materials M to be bound together. In this particular embodiment, a pair of stitches 18 are used for each set of materials M. Once stitches 18 have been secured to a set of materials M, first elongated member 14 is passed through one opening 56 defined by stitches 18 and side S for each set of materials M, as shown in FIGS. 1 and 2(*a*). As shown in FIG. 1, openings 56 defined by stitches 18 and sides S must line up. Once first elongated member 14 has passed through all of the openings 56 for sets of materials M to be bound together, other end 36 of second elongated member 16 is detachably secured to other end 34 of first elongated member 14 binding the sets of material M together within cover 20, as shown in FIG. 2(*b*). This process is then repeated for the other set of first and second elongated members 14 and 16. The width of spine 22 of cover 20 must be the same as or larger than the combined width of all of the sides S of each set of materials M to be bound together.

Figure 6A:
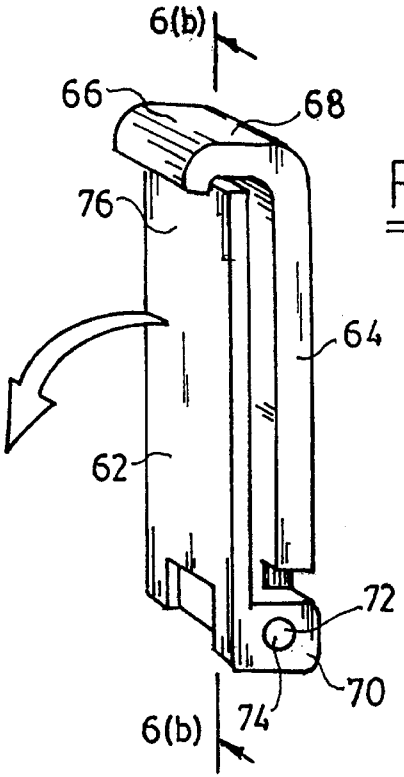
FIG. 6(*a*) is a perspective view of a another embodiment of a fastener used in the binding apparatus.
Figure 6B:
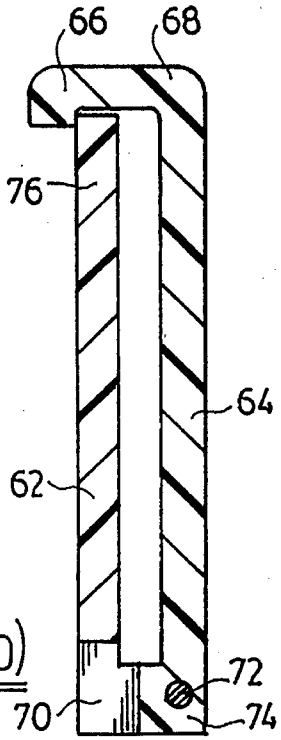

Referring to FIGS. 5(*a–c*), an alternative embodiment for binding apparatus 57 is illustrated. Fastener 58 is made from a rigid material, which in this particular embodiment is metal, although other types of rigid materials could be used as shown in FIGS. 6(*a–b*) and 7(*a–b*). First elongated member 62 is a substantially rectangularly-shaped piece which has a width and thickness which is smaller than the dimensions of opening 56 defined between stitch 54 and spine S. In this particular embodiment, first elongated member 62 is a rectangularly shaped piece of wire, although a solid piece of material could be used to form first elongated member 62. Second elongated member 64 also is a substantially rectangularly-shaped piece and has an engaging lip 66 at other end 68 of second elongated member 64. One end 70 of first elongated member 62 is pivotally connected by a hinge 72 to one end 74 of second elongated member 64, although other types of pivotal connections can be used to secure ends 70 and 74 together. Other end 76 of first elongated member 62 is capable of engaging with engaging lip 66 located at other end 68 of second elongated member 64 to secure first and second elongated members 62 and 64 together.

Cover 78 includes spine 80 which extends along axis B—B and front and back cover pieces 82 and 84 which are secured to opposing edges of spine 80 which are substantially parallel to the axis B—B. In this particular embodiment, cover 78 is made from a rigid material, such as cardboard or plastic. A securing device 86, such as a rivet or glue, is used to secure second elongated member 64 along the width of spine 80. The length of second elongated member 64 is less than or equal to the width of spine 80.

The operation of binding apparatus 57 illustrated in FIGS. 5(*a–c*) is the same as that described for binding apparatus 10 except as described below. As shown in FIG. 5(b), second elongated member 64 is secured by a securing device 86 to spine 80 of cover 78. Next, at least one stitch 54 is secured to each set of materials M to be bound together. Once stitches 54 have been secured to each set of materials M, first elongated member 62 is passed through openings 56 defined by stitches 54 and sides S for each set of materials M, as shown in FIGS. 5(*b*). Using a rigid material for first elongated member 62, makes it easier to pass first elongated member 62 through openings 56. As shown in FIG. 5(*a*), openings 56 defined by stitches 54 and sides S must line up. Once first elongated member 62 has passed through all of the sets of materials M to be bound together, then second elongated member 64 is pivotally moved to detachably secure other end 76 of first elongated member 62 under engaging lip 66 at other end 68 of second elongated member 64 to bind sets of material M together within cover 78, as shown in FIG. 5(*c*).

Figure 7A:
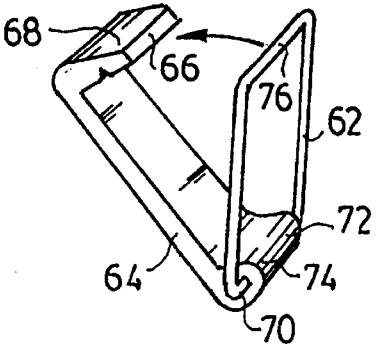
FIG. 7(*a*) is a perspective view of yet another embodiment of a fastener used in the binding apparatus in an open position.
Figure 7B:
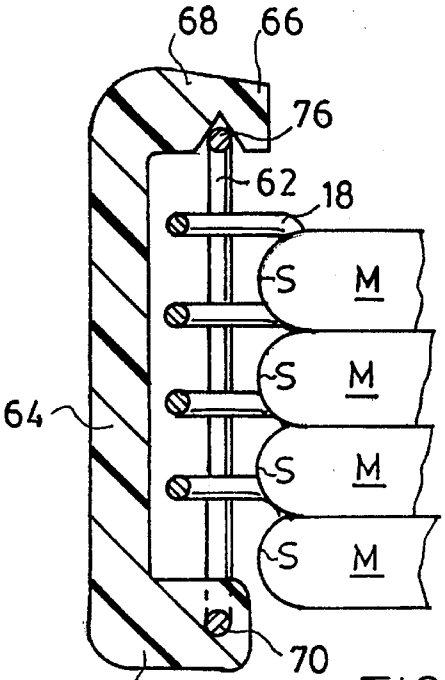

Referring to FIGS. 6(*a–b*) and 7(*a–b*), alternative embodiments for fastener 58 are illustrated. Corresponding elements in FIGS. 6(*a–b*) and 7(*a–b*), have numeral designations which correspond to those used in FIGS, 5(*a–b*) and thus will not be described in detail here again. As shown in FIGS. 6(*a–b*), fastener 58 may be made entirely from a plastic. As shown in FIGS. 7(*a–b*), first elongated member 62 may be made from metal and second elongated member 64 may be made from plastic, although the choice of materials for members 62 and 64 could be reversed. The operation of the different embodiments of fastener 58 shown in FIGS. 6(*a–b*) and 7(*a–b*) is the same as the operation of fastener 58 shown in FIGS. 5(*a–b*) and thus will not be described again.

Figure 8A:
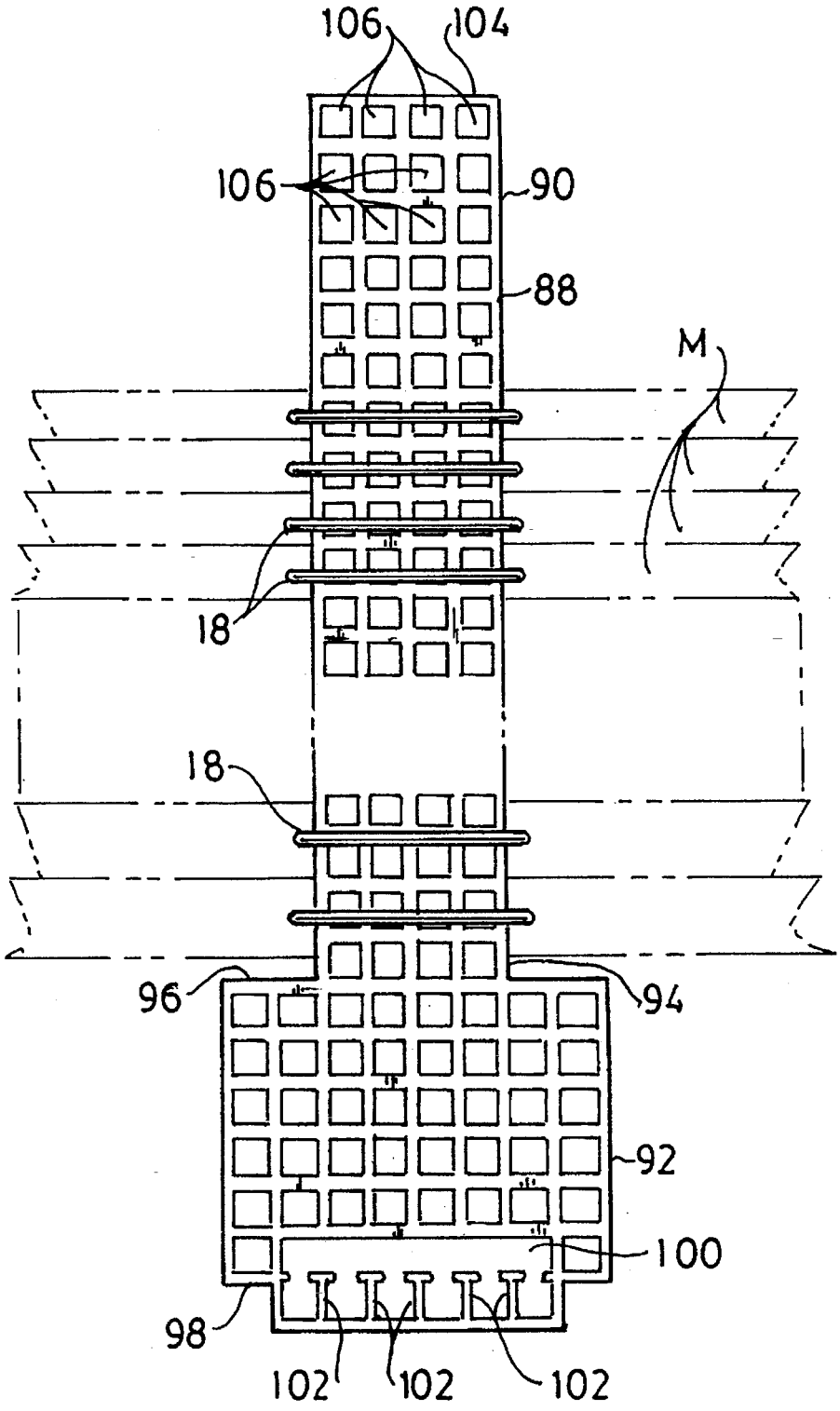
FIG. 8(*a*) is a front view of yet another embodiment of a fastener used in the binding apparatus in an open position.

Referring to FIGS. 8(*a–b*), yet another embodiment for fastener 88 is illustrated. First elongated member 90 is integrally formed with second elongated member 92 at ends 94 and 96. Second elongated member 92 may be secured to spine of a cover if desired, with glue, rivets, or other securing means. Other end 98 of second elongated member 92 has an opening 100 with teeth 102 extending into opening 100. Although five teeth 102 are shown, fastener 102 can have more or fewer teeth 102 if desired. First elongated member 90 has a width which is designed to fit between the opening 56 between the side S of a set of materials M and a stitch 18. Other end 104 of first elongated member 90 has twelve rows of openings 106. Each opening 106 is designed to have dimensions large enough to receive one tooth 102. Although twelve rows of four openings 106 in a row are illustrated, elongated member 90 can have any number of rows of openings 106 and any number of openings 106 in a row desired.

Figure 8B:
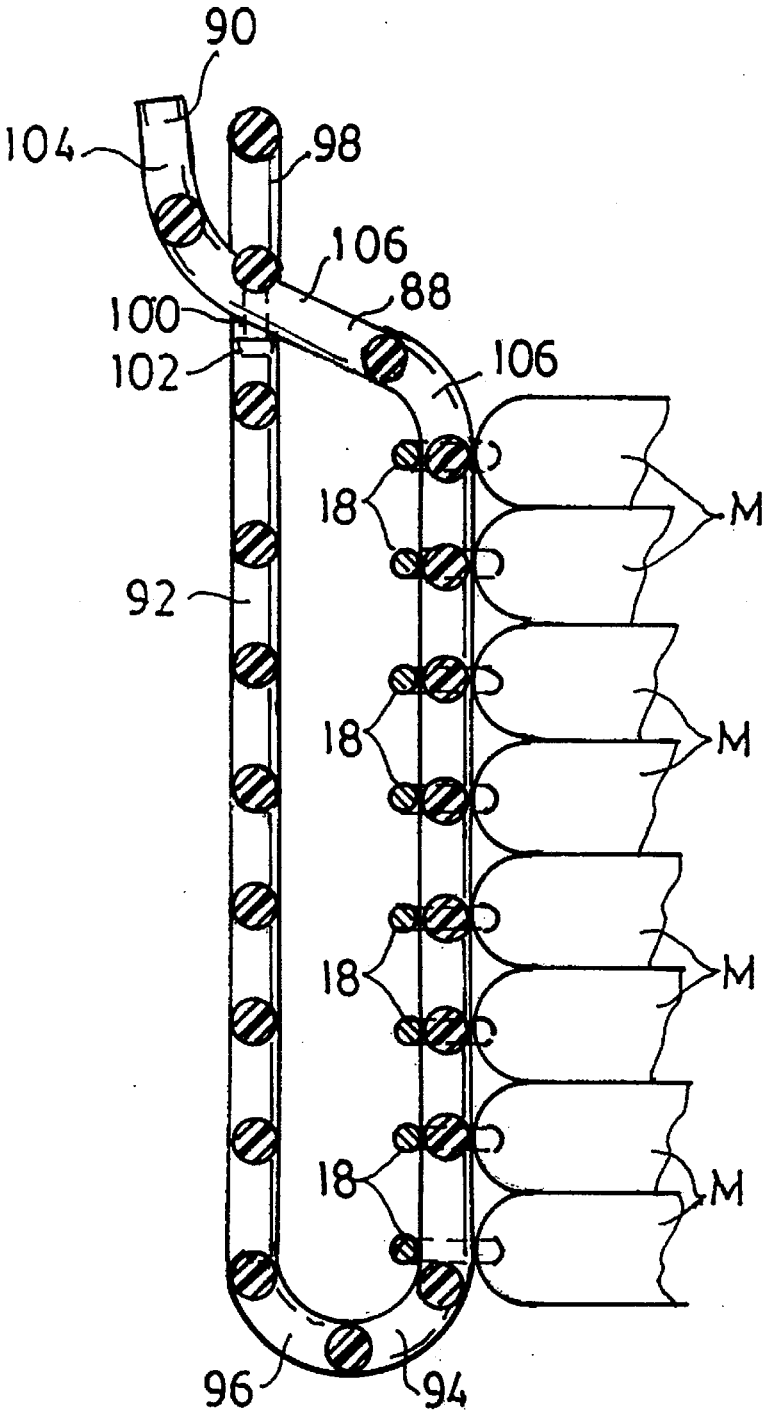

When end 104 of first elongated member 90 is passed through opening 100, then one row of openings 106 are designed to detachably receive teeth 102 and secure ends 98 and 104 together and also securing materials M together as shown in FIG. 8(b). Member 90 is detached from member 92 by disengaging teeth 102 from openings 106 and then removing member 90 from opening 100. Fasteners 12 and 58 shown in FIGS. 1, 2(*a–b*), 5(*a–c*), 6(*a–b*), 7(*a–b*), and 8(*a–b*) are illustrative only and other types of fasteners with first and second elongated members could be used if desired.

Having thus described the basic concept of the invention, it will be readily apparent to those skilled in the art that the foregoing detailed disclosure is intended to be presented by way of example only, and is not limiting. Various alterations, improvements, and modifications will occur and they are intended to those skilled in the art, though not expressly stated herein. These modifications, alterations, and improvements are intended to be suggested hereby, and are within the spirit and scope of the invention. Accordingly, the invention is limited only by the following claims and equivalents thereto.

What is claimed is:

1. An apparatus for binding one or more pages together, each page having a first side extending along a first axis, said apparatus comprising:

at least one stitch secured adjacent to the first side with a portion of said stitch extending away from the first side to define an opening between said stitch and the first side; and a fastener having first and second elongated members, said first and second elongated members each having a pair of opposing ends, with one end of said first elongated member connected to one end of said second elongated member;

said first elongated member extending through said opening between said stitch and the first side, said other ends of said first and second elongated members detachably secured together to bind the pages together.

2. The apparatus as set forth in claim 1 further comprising:

a cover having a spine extending along a second axis, a front and a back cover piece connected to opposing sides of said spine; and a securing device connecting said second elongated member to said spine.

3. The apparatus as set forth in claim 1 wherein said stitch comprises:

a U-shaped section with a base and a pair of legs extending out from opposing ends of said base, said pair of legs being substantially parallel to each other until a first bend where said legs are bent to be substantially perpendicular to said U-shaped section while remaining substantially parallel to each other and extending to a second bend where said legs are bent towards each other so that said legs overlap.

4. The apparatus as set forth in claim 1 wherein said first and second elongated members of said fastener are made from a flexible material.

5. The apparatus as set forth in claim 4 wherein said flexible material is velcro.

6. The apparatus as set forth in claim 1 wherein said first and second elongated member of said fastener are made from a rigid material, said one end of said first and second elongated members being pivotally connected together and said other end of said second elongated member detachably connected under a lip adjacent the other end of said second elongated member.

7. The apparatus as set forth in claim 6 wherein said first and second elongated members are made from metal.

8. The apparatus as set forth in claim 6 wherein said first and second elongated members are made from plastic.

9. The apparatus as set forth in claim 6 wherein said first elongated member is made from metal and said second member elongated is made from plastic.

10. The apparatus as set forth in claim 1 wherein said first and second elongated members are pivotally connected at one end, said other end of said first elongated member having at least one first opening and said other end of said second elongated member having a second opening with at least one tooth extending in to said second opening, wherein said tooth extends in to said first opening when said other end of said first elongated member is passed through said second opening in said second elongated member to detachably connect said other ends of said first and second elongated members together.

11. The apparatus as set forth in claim 10 wherein said first and second elongated materials are made from plastic.

12. An apparatus for binding one or more pages together, each page having a first side extending along a first axis, said apparatus comprising:

at least one stitch comprising a U-shaped section with a base and a pair of legs each having an end, said legs extending out from said base of said U-shaped section and being substantially parallel to each other until a first bend where said legs are bent to be substantially perpendicular to said U-shaped section while remaining substantially parallel to each other and extending to a second bend where said ends of said legs are bent towards each other, said stitch secured adjacent to the first side with at least a portion of said U-shaped section extending away from the first side to define an opening between said U-shaped section and the first side;

a cover having a spine extending along a second axis and front and back cover pieces, said front and back cover pieces connected to said spine along said second axis; and a fastener secured to said spine and capable of being passed through each said opening between said U-shaped section and the first side to bind the pages together within said cover.

13. The apparatus as set forth in claim 12 wherein said fastener is made from a flexible material.

14. The apparatus as set forth in claim 12 wherein said fastener is made from a rigid material.

15. The apparatus as set forth in claim 12 wherein said first and second elongated member of said fastener are made from a rigid material, said one end of said first and second elongated members being pivotally connected at a hinge and said other end of said second elongated member capable of being detachably connected under a lip adjacent the other end of said second elongated member.

16. The apparatus as set forth in claim 12 wherein said first and second elongated members are pivotally connected at one end, said other end of said first elongated member having at least one first opening and said other end of said second elongated member having a second opening with at least one tooth extending in to said second opening, wherein said tooth extends in to said first opening when said other end of said first elongated member is passed through said second opening in said second elongated member to detachably connect said other ends of said first and second elongated members together.

17. An apparatus for binding one or more pages together, each page having a first side extending along a first axis, said apparatus comprising:

at least one stitch comprising a U-shaped section with a base and a pair of legs each having an end, said legs extending out from said base of said U-shaped section and being substantially parallel to each other until a first bend where said legs are bent to be substantially perpendicular to said U-shaped section while remaining substantially parallel to each other and extending to a second bend where said legs are bent towards each other, said stitch secured adjacent to the first side with at least a portion of said legs adjacent said second bend extending away from the first side to define an opening between said legs and the first side;

a cover having a spine extending along a second axis and front and back cover pieces, said front and back cover pieces connected to said spine along said second axis; and a fastener secured to said spine and capable of being passed through each said opening between said legs adjacent said second bend and the first side to bind the pages together within said cover.

18. The apparatus as set forth in claim 17 wherein said fastener is made from a flexible material.

19. The apparatus as set forth in claim 18 wherein said fastener is made from a rigid material.

20. The apparatus as set forth in claim 19 wherein said first and second elongated member of said fastener are made from a rigid material, said one end of said first and second elongated members being pivotally connected at a hinge and said other end of said second elongated member capable of being detachably connected under a lip adjacent the other end of said second elongated member.

21. The apparatus as set forth in claim 17 wherein said first and second elongated members are pivotally connected at one end, said other end of said first elongated member having at least one first opening and said other end of said second elongated member having a second opening with at least one tooth extending in to said second opening, wherein said tooth extends in to said first opening when said other end of said first elongated member is passed through said second opening in said second elongated member to detachably connect said other ends of said first and second elongated members together.

22. A stitch for binding one or more pages together, said stitch comprising a U-shaped section with a base and a pair of legs each having an end, said legs extending out from said base of said U-shaped section and being substantially parallel to each other until a first bend where said legs are bent to be substantially perpendicular to said U-shaped section while remaining substantially parallel to each other and extending to a second bend where said ends of said legs are bent towards each other.

23. The stitch as set forth in claim 22 wherein said ends of said legs overlap.

* * * * *